United States Patent [19]

Bickerdike et al.

[11] 4,033,793

[45] July 5, 1977

[54] ALUMINIUM ALLOYS

[75] Inventors: Robert Lewis Bickerdike, Alton; Douglas Clark, Camberley; John Norman Eastabrook, Basingstoke; Garyth Hughes; William Norman Mair, both of Farnham; Peter George Partridge, Camberley; Harry Christopher Ranson, Farnborough, all of England

[73] Assignee: The Secretary of State for Defence in Her Britannic Majesty's Government of the United Kingdom of Great Britain and Northern Ireland, London, England

[22] Filed: Sept. 15, 1975

[21] Appl. No.: 613,498

[52] U.S. Cl. ..... 148/32; 75/138

[51] Int. Cl.² ..... C22C 21/00

[58] Field of Search ..... 75/138, 147, 139, 140, 75/141, 142, 143, 146, 148; 148/32

[56] References Cited

UNITED STATES PATENTS 1,870,732 8/1932 Iytaka ..... 75/147

*Primary Examiner*—R. Dean

*Attorney, Agent, or Firm*—Stevens, Davis, Miller & Mosher

[57] ABSTRACT

An aluminium alloy is provided which consists of 2 to 12% by weight of chromium, 0.2 to 3.0% by weight of iron, the balance being aluminium apart from minor proportions of impurities and incidental elements wherein most of the chromium is present as a metastable solution in the aluminium lattice which contains a precipitate phase of iron rich zones the major proportion of which have dimensions of 200A or less, the presence of large intermetallic particles, particularly at grain boundaries, being at a minimum. This alloy may be produced by an evaporation deposition process.

10 Claims, 4 Drawing Figures

ALUMINIUM ALLOYS

The present invention is concerned with evaporation-condensation alloys, that is alloys produced by evaporation-condensation processes.

In accordance with the present invention an evaporation-condensation aluminium alloy consists of 2 to 12% by weight of chromium, 0.2 to 3.0% by weight of iron, the balance being aluminium apart from minor proportions of impurities and incidental elements wherein most of the chromium is present as a mestastable solution in the aluminium lattice which contains a precipitate phase of iron rich zones the major proportion of which have dimensions of 200A or less, and preferably 50A or less, the presence of large intermetallic particles, particularly at grain boundaries, being at a minimum.

Impurities and incidental elements which may be present in alloys of the present invention may include a total of up to about 0.5% by weight of any one or more of the following: nickel, cobalt, silicon, copper, zinc, gold, silver, oxygen, magnesium, cadmium, tin, manganese, titanium, molybdenum, carbon and beryllium.

Advantageously aluminium alloys of the present invention consist of 4 to 10% by weight of chromium, 0.3 to 2.0% by weight of iron, the balance being aluminium apart from minor proportions of impurities and incidental elements, and preferably consist of 5 to 9% by weight of chromium and 0.6 to 1.5% by weight of iron. In a particularly preferred embodiment of the present invention an aluminium alloy consists of 5 to 8% by weight of chromium, 0.8 to 1.3% by weight of iron, the balance being aluminium apart from minor proportions of impurities and incidental elements; a major part of the chromium content being present as a metastable solid solution in the aluminium lattice and having a precipitate phase or iron rich zones a major proportion of which have dimensions of 50A or less. Preferably substantially all of the iron rich zones have dimensions of 50A.

The microstructures which are characteristic of the alloys of the present invention, which may require appropriate working treatment to achieve, are not obtainable by conventional melting casting, forging or solution heat treatment and precipitation techniques.

The techniques of producing alloys by deposition from the vapour phase is described in UK Pat. Specification 1,206,586. A proces of producing an evaporation-condensation alloy of the present invention includes the steps of evaporating the constituents of the alloy from a heated source means within a vacuum or low pressure system, depositing the constituents of the alloy upon a temperature controlled collector until a required thickness is deposited and opening the vacuum or low pressure system and removing the deposit from the collector in a condition capable of undergoing metallurgical working.

Alloys in accordance with the present invention may have very useful mechanical properties after suitable working in order to consolidate them. In particular they may be strong and ductile at room temperature and have impact strength, Young's modulus, fatigue properties, elevated temperature tensile strength, creep resistance and corrosion behaviour much better than those of other aluminium alloys commonly used heretofor.

It has been found that the microstructure of alloys obtained by evaporation-condensation varies considerably with the temperature at which the collector is controlled. For example the microstructure characteristic of alloys of the present invention is obtained when the collector temperature is controlled at about 260° C. When the collector temperature is maintained at about 370° C an easily worked, high strength alloy may be produced in which the iron and chromium are substantially entirely in the form of a precipated phase or phases of fine particles, a major proportion of which have dimensions of about 2000 A or less. Such an alloy may have low porosity but may have a tendency to poor corrosion properties. At collector temperatures between about 260° C and 370° C alloys with microstructures intermediate these two types are formed. At collector temperatures below about 260° C, for example about 170° C, a more porous deposit without the precipitate phase of iron rich zones is obtained but working, ie pressing and or rolling, may remove the porosity and heat treatment causes precipitation of the iron rich zones.

It has been discovered that the metastable solution of chromium in the aluminium lattice when originally deposited is in the form of narrow elongated grains having a diameter of 5$\mu$m or less. After working, for example hot pressing or hot rolling these grains can be converted to flat extended plate like grains having a thickness of 5$\mu$m or less. Preferably these dimensions of the grains are 1/$\mu$m or less.

After suitable working alloys of the present invention may be obtained with a tensile strength of at least 45 tonf/in$^2$.

Apparatus suitable for the production of alloys in accordance with the present invention is illustrated in the accompanying drawings in which.

Figure 1:
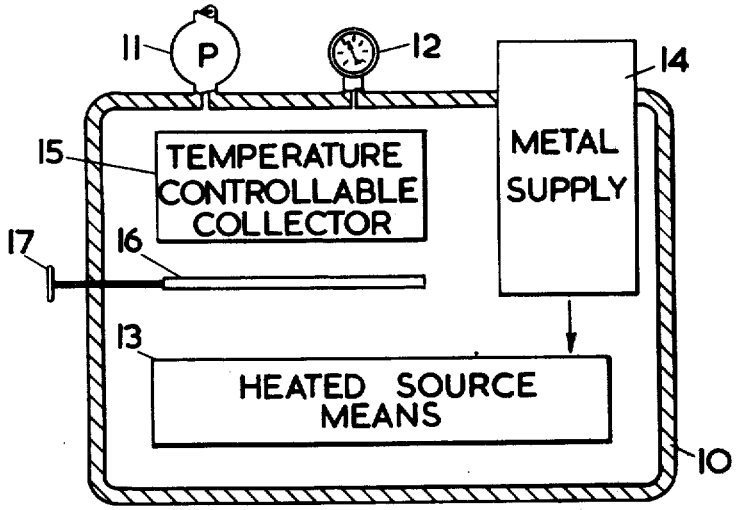
FIG. 1 is a schematic cross-sectional representation.

Referring now to FIG. 1 which is a schematic representation, a vacuum or low pressure vessel 10 is evacuated by a conventional vacuum pump 11 and a pressure gauge 12 is provided to monitor the pressure. A heated source means 13 is provided with metal by a metal supply 14 and a temperature controllable collector 15 is provided upon which metal evaporated from the heated source means 13 may be deposited. A removable shutter 16 is provided operated by a handle 17 outside the vacuum vessel 10. The metal supply means 14 is preferably provided with a vacuum lock so that it can be charged without breaking the vacuum in the vacuum vessel 10, and in duplicate so that one may be charged while the other is in operation and continuous operation thus achieved.

Figure 2:
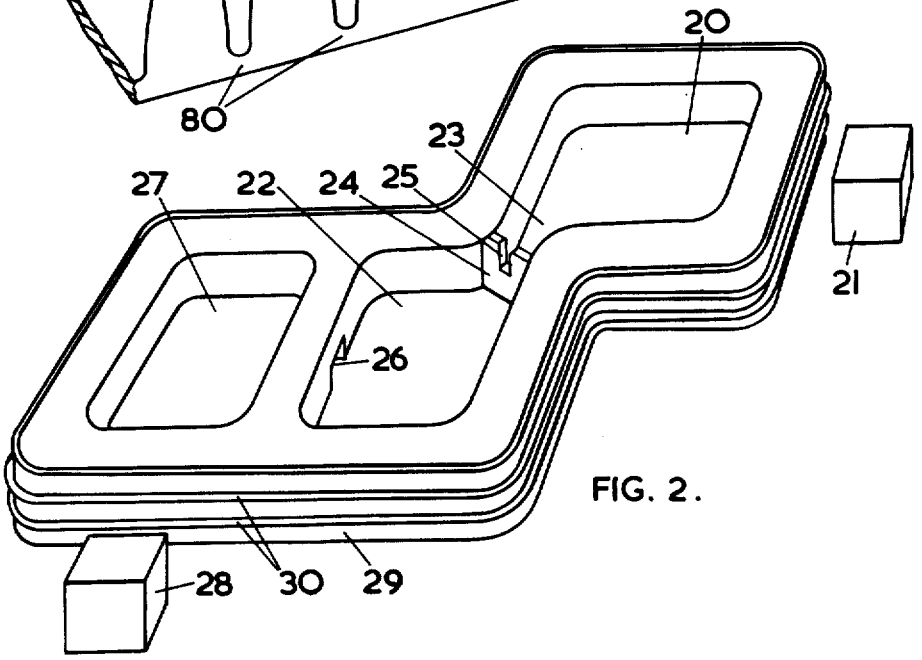
FIG. 2 is a perspective view of a controllably heated source means.

Any suitable heated source means may be used but preferably the controllably heated source means disclosed in copending Patent Application 33073/72 is used. FIG. 2 is a perspective view of one embodiment of a controllably heated source means and is shown empty so that the internal structure is visible. A melting compartment 20 heated by an electron gun 21 connects with a mixing compartment 22 through a channel 23 which contains a partition 24 with a slit 25 therein. The mixing compartment 22 connects with a channel 26 with an evaporation compartment 27 heated by an electron gun 28. The compartments are enclosed in a copper cooling jacket 29 provided with copper pipes 30 for the circulation of cold water, the entrance and exit of which is not shown. The material of the compartments is heat and corrosion-resistant ceramic.

Figure 3:
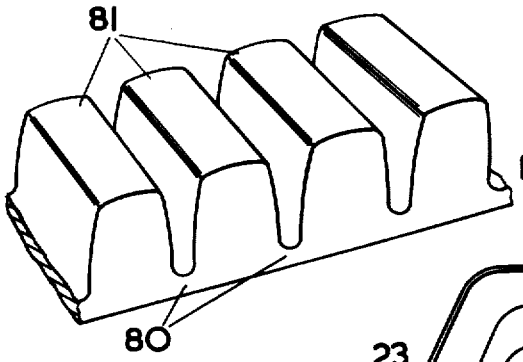
FIG. 3 is a shaped ingot of feed metal.

Metal may be supplied to the heated source means 13 in the form of dics obtained by casting a cylindrical ingot, turning it on a lathe and cutting it into evenly sized discs. One suitable feed mechanism is described in copending Patent Application 33075/72. However preferably metal is supplied in the form of an ingot as illustrated in FIG. 3. Such an ingot is cast in such a manner that the necks 80 solidify first and early in the solidification so that each of the pieces 81 has substantially the nominal composition of the original material. This can be lowered into a melting vessel in such a manner that it melts one piece at a time and is degassed.

Figure 4:
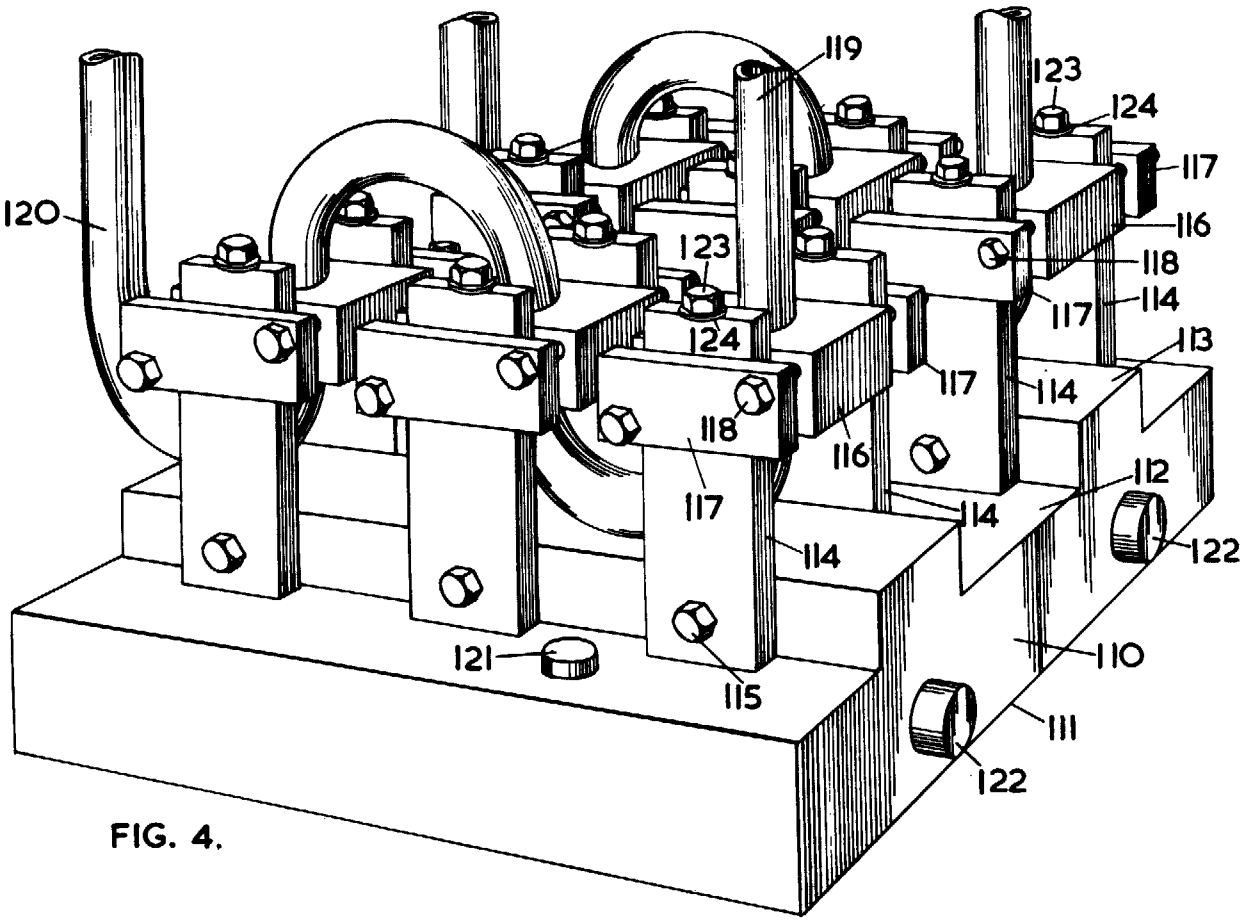
FIG. 4 is a perspective view of a temperature controllable collector.

Suitable specific temperature controllable collectors 15 are described in U.K. Pat. Specification 1,279,975 and copending Patent Application 33072/72. However a preferred form of collector is disclosed in copending Patent Application 3307472 and one embodiment is shown in perspective view in FIG. 4. The collector 15 comprises a thick metal plate 110 having a surface 111 for the deposition of the alloy and on the reverse surface 112 two longitudinal ridges 113. A metal is selected which has a similar coefficient of thermal expansion as the alloy to be deposited. Coppor bars 114 are bolted in pairs to the ridges by means of a single bolt 115 per pair. A copper block 16 is held between each pair of plates 114 by end plates 117 positioned outside the copper bars 114 and having bolts 118 passing through the copper block 116. Individual copper blocks 116 are hollow having inlet and outlet pipe 119 and 120.

The shank of the bolt 115 has a lower coefficient of thermal expansion than the material of the ridge 113 so that when the assembly heats up the bars 114 are pulled more tightly on the ridges 113 ensuring efficient thermal contact. Similarly the bolts 118 have a lower coefficient of thermal expansion than copper so that efficent thermal contact is ensured between the bars 119 and copper block 116. The collector plate 110 is also provided with a thermocouple 121 by which the temperature of the surface 111 can be monitored. Heaters 122 to pre-heat the plate 110 are also provided. Leads to thermocouple 121 and heaters 122 are not shown. A safety device is provided at the top of each bar 114 to prevent the collector falling into the source 13 should the bolts 118 loosen for any reason. The safety device consists of a washer 124 extending beyond the edges of the bar 114 and held in place by a bolt 123.

In use the thickness of the bars 114 are preselected according to the required operating temperature of the collector. For example, increasing the thickness of the bars 114 increases the heat flux which they carry and thus for a given thermal input lowers the temperature of the collector plate. 110. Similarly the copper blocks 116 can be positioned close to the plate 110 to remove heat more quickly again resulting in a relatively lower plate temperature. During operation of the apparatus minor adjustments can be made by varying the rate of flow and/or temperature of the cooling fluid, which is preferably water.

In a typical deposition the collector is of aluminium alloy, such as duralumin, and is polished and cleaned before deposition begins. Cleaning may be carried out by washing with detergent, rinsing, drying and heating to about 250° C, or any suitable alternative process. One suitable process is by glow discharge cleaning, as disclosed in copending Patent Application 28065/72. The metal charge is also washed with detergent, rinsed and dried. The desired quantities of metal charge are then loaded into the container or containers of the heated source means, and the feed magazine. The relative concentrations of aluminium:chromium: iron in the starting material in the compartment 27 are not of course the same as the nominal concentrations required in the condensed alloy, due to the widely differing fugacities of the metals. However the initial concentrations required to produce an alloy of the present invention may easily be ascertained by those experienced in the art.

The apparatus is then assembled and the system evacuated, generally to about 1 to 2 $\times 10^{-5}$ torr. The collector 15 is then preheated to the required operating temperature, for example by heaters 122, and is then maintained as near to this temperature as possible throughout the entire deposition experiment. The temperature of the heated source means 13 is then raised until the charge is evaporating fast, for example by means of electron guns 21 and 28, however the shutter 16 is kept in place until splashing of the charge has essentially stopped. The shutter 16 is then removed so that deposition on to the collector 15 may take place, extra charge from the matal supply 14 being admitted at suitable regular intervals. Deposition is terminated when a desired thickness has been deposited on the collector by switching off the electron guns, allowing the collector to cool and opening the vacuum chamber. The deposit may then be removed from the collector by any suitable means. For thick deposits a band-saw may be used whilst for thin deposits the application of a parting agent to the surface of the collector prior to deposition may allow easy peeling of the deposit from the collector.

Alloys of the present invention require mechanical working by any suitable working technique in order to consolidate them prior to use. Advantageously the working temperature should not exceed the temperature at which the collector was maintained during deposition. Suitable working techniques to consolidate and thus remove porosity may include pressing and rolling or extrusion and be followed by shaping. Other techniques may include annealing and/or stretching to remove internal stress.

The following Examples describe specific alloys within the present invention and processes by which they may be produced and are given by way of example only, except Example 2 which is of the production of an alloy not having the desired structure.

EXAMPLE 1

A crucible of the type illustrated in FIG. 2 was used. The following materials were loaded in the melting compartment 20, the mixing compartment 22 and the evaporation chamber 27 respectively:

20

945 grams Al 10% Cr ingot
945 grams 99,8% Al plate

22

706 grams Al 10% Cr ingot 63 grams Swedish iron

27

1650 grams 99.8% Al plate
480 grams Cr arc-melted buttons 533 grams Swedish iron A feed magazine, (the metal supply means 14) was loaded with 148 discs of 64 mm diameter, consisting alternatively of discs of 9.1–9.5% Cr in Al weighing 74g each, and 99.8% Al discs weighing 53g each. All the charge was first washed with detergent, rinsed and dried. A duralumin block collector of the type shown in FIG. 4 was place with its lower surface 360 mm above the evaporation chamber 27 of the crucible, the removable shutter 16 being positioned between. The collector had previously been polished washed and dried.

The vacuum chamber containing crucible, collector and feed magazine was pumped out to about $2 \times 10^{-5}$ torr. The collector was then heated to 320° C and when the shutter was opened the current in the collector heaters was reduced and the collector temperature maintained as near to 320° C as possible, ie from 308° C to 323° C, during the rest of the experiment.

The electron gun 21 was switched on and the beam was focussed on the metal in the melting compartment 20; the accelerating voltage was 18 Kv and the emission current about 300 mA. The second electron gun 28 was switched on, and the beam was focussed on to the metal in the evaporating compartment 27 of the crucible; accelerating voltage 15.5 Kv, emission current about 250 mA. The voltages on both guns were kept constant and the emission currents were gradually increased to melt the crucible charge without too much splashing. After about 70 minutes the emission current of electron gun 21 had reached 1 amp, and splashing had essentially stopped. Three minutes later the shutter was moved away to allow deposition of evaporated metal on the collector lower surface. Two minutes after this the mechanical feeding of discs from the feed magazine into crucible chamber 20 was started, one disc being introduced about every 100 seconds, until after a further period of 3 hours 50 minutes a total of 139 discs had been introduced. The deposition was then terminated by switching off the electron guns, the collector was allowed to cool, and the vacuum chamber was opened. During the feeding of the discs the emission current of gun 21 was about 1.06 amps and that of gun 28 was 520–620 mA.

The deposit was removed from the collector with a band-saw. The chromium and iron contents near the central region of the deposit were: Cr. 4.8 to 6.9%, Fe 1.0 to 0.8%.

Slabs cut from the deposit were worked to sheet by pressing followed by rolling, using pressing temperatures in the range 20° C to 260° C and rolling temperature nominally in the range 20° C to 230° C. For example one piece was pressed at 20° C from an initial thickness of 0.47 inch to a thickness of 0.16 inch and rolled at 20° C down to a thickness of 0.052 inch. It had a room temperature tensile strength in this condition of 44 tonf/ins² with an elongation of 5%. Another piece was pressed at 250° C from an initial thickness of 0.75 inch to a thickness of 0.30 inch and then rolled to a final thickness of 0.057 inch. It had a room temperature tensile strength of 43 tonf/ins² and an elongation of 5%. The Young's modulus was in both cases about 11.5 $\times 10^6$ psi.

A third piece was pressed at 200° C from a thickness of 0.55 inch to 0.32 inch and then rolled at 200° C and below to 0.064 inch. It had a tensile strength of 43 tonf/ins² at room temperature, elongation 6%, and a tensile strength of 28 tonf/ins² at 300° C, elongation 10%.

A fourth piece was pressed at 250° C from 0.71 inch to 0.25 inch and rolled at 230° C to 0.058 inch. It had a tensile strength at room temperature of 45 tonf/ins², elongation 4%, and a tensile strength at 200° C of 37 tonf/in, elongation 6%.

Specimens pressed at 200 to 250° C from 0.55 inch to 0.25 inch and rolled at 230° C to 0.06 inch had the following mechanical properties:

a. Fatigue (tested at fatigue cycle p+0.9p where $p$ = stress)
   1. Holed test piece (elastic stress concentration factor $K_t = 2.6$)
      At peak stress (1.9p) of 25000 lbf/in²: Sample unbroken after $2.9 \times 10^7$ cycles.
      At peak stress of 25500 lbf/in²: Sample unbroken after $1 \times 10^8$ cycles.
   2. Plain test piece
      At peak stress of 40,000 lbf/in²: Sample unbroken after $5.3 \times 10^7$ cycles.
      Results obtained indicate a fatigue strength about 35% greater than standard aluminium aircraft alloys (for example 2024-T3: an Al-Cu-Mg alloy).

b. Creep
   Stress for 0.1% total plastic strain in 100 hours at 251° C = 10 tonf/in².
   Stress for 0.1% total plastic strain in 100 hours at 223° C = 15 tonf/in².
   Stress for 0.1% total plastic strain in 100 hours at 183° C = 20 tonf/in².
   Stress for 0.1% total plastic strain in 1000 hrs at 195° C = 14 tonf/in².
   Results obtained indicate that this alloy has about a factor of 2 advantage in stress, and, for a stress of 20 tonf/in² a 70° C advantage in temperature over a standard aluminium aircraft alloy (for example CMOO1-1C).

c. Impact
   Impact properties were measured using miniature Charpy test pieces, 2.8 × 2.8 × 40 mm unnotched (UN) or notched (N) with 45° notch, 0.6 mm deep and 0.15 mm root radius.
   Results obtained were
   UN 5.5 to 6.2 ft lb unbroken
   N 0.9 to 2.5 ft lb unbroken
   These impact strengths are comparable with the titanium alloys IMI 318 (Ti-6A1-4V) and IMI 685 (Ti-6-A1-5Zr).

d. Corrosion
   Weight loss in 5% aqueous NaCl at 36° C.
   At condensation rate of 1.5 ± 0.5 mls/hr over a sample area of 80 cm² for 6 weeks exposure the weight loss is less than 0.45 mg/cm², which is similar to that of pure aluminum.

NOTE: The chemical composition of each test piece is not known precisely but it is in, or near to the range of composition given above.

EXAMPLE 2

An experiment was carried out essentially as described in example 1, except that the crucible only had two interconnected chambers — an evaporation chamber and a feed chamber. One electron beam played on the metal in the evaporation chamber, and the thermal conduction occurred from this chamber into the feed chamber sufficient to melt the feed.

The collector temperature was held at 356° C to 374° C during deposition.

The deposit composition near the central region was: Cr 6.3% to 8.0%; Fe 0.9% to 1.4%.

Several pieces of the deposite were worked as in example 1. Thus one piece was pressed at 230° C from 0.46 inch to 0.14 inch in thickness and then rolled at 210° C to 0.054 inch. Its room temperature tensile strength was 43 tons/in², elongation 8%, Young's Modulus 11 × 10⁶ psi. Another piece was rolled warm, without prior pressing, from a thickness of 0.33 inch to 0.044 inch. It had a room temperature tensile strength of 40 tons/in², elongation 8%, Young's Modulus 12 × 10⁶ psi.

EXAMPLE 3

A deposit was made by the method described in example 1, except that the collector was heated initially to 260° C and held, during deposition, in the temperature range 252° C to 258° C. The amount of metal evaporated was 9.2 kg in about 3 hours 40 minutes. The composition of the deposit near the central region was: Cr 7.6 to 7.8%; Fe 0.99% to 1.14%. One piece of the deposit was pressed at 260° C to 230° C from a thickness of 0.47 inch to 0.20 inch, and then rolled at 235° C to 250° C down to a thickness of 0.063 inch. In this condition the room temperature tensile strength was 47 tonf/in² with an elongation of 8%, and the tensile strength at 200° C was 40 tonf/in² with an elongation of 6%.

EXAMPLE 4

This deposit was formed under the same conditions as those given in example 3, except that the feed was introduced as ingot as illustrated in FIG. 3 and which was lowered from a vertical stock as contained in an evacuated tower as described in copending Patent Application 33075/72. The feed stack contained 7.9 Kg of ingots of composition Al, 7% Cr, 1.5% Fe. There were four lengths of ingot held one below the other by iron wire. The centre of the deposit had the following composition: Cr 7.5% Fe 1.6%.

The deposit was cut off and small pieces were worked and tested as described in Example 1, and exhibited similar mechanical properties.

EXAMPLE 5

This deposit was made under the same conditions as those used in example 4, but a crucible charge and ingot feed stack richer in iron were used in order to obtain a deposit with a higher iron content.

Thus:

melting chamber 20
- 81g Swedish iron
- 162g arc-melted Cr buttons
- 3008g 99.8% Al plate mixing chamber 22
- 391g Swedish iron
- 137g Cr buttons
- 622g Al plate evaporation chamber 27
- 1260g Swedish iron
- 445g Cr buttons
- 2000g Al plate The feed stack contained 8.2 kg of Al, 5% Cr 2.5% Fe ingot.

The collector was held at 262° to 273° C during deposition. The central region of the deposit had the composition 6.8% to 8.5% Cr, 3.7% to 4.3% Fe, balance Al.

The deposit was worked and tested as in previous examples, after having been cut from the collector.

EXAMPLE 6

This deposit was similar to that given in example 5 but with lower Cr and Fe contents. The crucible and feed charges were as follows:

20
- 47g Fe
- 95G Cr
- 2030g Al

22
- 237g Fe
- 79g Cr
- 710g Al

27
- 765g Fe
- 256g Cr
- 2300g Al

The feed stack contained 8.5 kg of ingot of composition 3% Cr 1.5% Fe balance Al.

The composition of the central region of the deposit was 3.1% to 3.9% Cr, 1.2% to 1.58% Cr balance Al. The deposit was worked and tested as in previous examples after having been cut off the collector.

It should be noted that the materials produced in accordance with the above described Examples suffered from a certain amount of porosity, which resulted in cracks appearing at the edges of the sample as these were worked. Such cracked portions were cut off and discarded before further working or use as test samples.

What I claim is:

1. an evaporation-condensation aluminum alloy which consists of 2 to 12% by weight of chromium, 0.2 to 3.0% by weight of iron, the balance being aluminum apart from minor proportions of impurities and incidental elements wherein most of the chromium is present as a metastable solution in the aluminum lattice in the form of grains having one dimension of 5 μm or less, said grains containing a precipitate phase of iron-rich zones the major proportion of which have dimensions of 200A or less, the presence of large intermetallic particles, particularly at grain boundaries, being at a minimum.

2. An alloy as claimed in claim 1 which consists of 4 to 10% by weight of chromium and 0.3 to 2.0% by weight of iron.

3. An alloy as claimed in claim 1 which consists of 5 to 9% by weight of chromium and 0.6 to 1.5% by weight of iron.

4. An alloy as claimed in claim 1 which consists of 5 to 8% by weight of chromium, 0.8 to 1.3% by weight of iron and in which a major proportion of the iron rich zones have dimensions of 50A or less.

5. An alloy as claimed in claim 4 wherein substantially all of the iron rich zones have dimensions of 50A or less.

6. An alloy as claimed in claim 1 and wherein the metastable solution of chromium in the aluminium lattice is in the form of narrow elongated grains having a diameter of 5μm or less.

7. An alloy as claimed in claim 1 and wherein the metastable solution of chromium in aluminium lattice is in flat extended plate like grains having a thickness of 5μm or less.

8. An alloy as claimed in claim 5 and wherein the dimension of the grains is 1 μm or less.

9. An alloy as claimed in claim 6 and wherein the dimension of the grains is 1 μm or less.

10. An alloy as claimed in claim 7 and wherein the dimension of the grains is 1 μm or less.

* * * * *